US011131241B2

(12) United States Patent
Tojo et al.

(10) Patent No.: US 11,131,241 B2
(45) Date of Patent: Sep. 28, 2021

(54) MULTI-LINK PISTON CRANK MECHANISM FOR INTERNAL COMBUSTION ENGINE

(71) Applicant: NISSAN MOTOR CO., LTD., Yokohama (JP)

(72) Inventors: Tomoya Tojo, Kanagawa (JP); Takashi Tanabe, Kanagawa (JP); Makoto Kobayashi, Kanagawa (JP)

(73) Assignee: NISSAN MOTOR CO., LTD., Yokohama (JP)

( * ) Notice: Subject to any disclaimer, the term of this patent is extended or adjusted under 35 U.S.C. 154(b) by 0 days.

(21) Appl. No.: 16/972,106

(22) PCT Filed: Jun. 7, 2018

(86) PCT No.: PCT/JP2018/021801
§ 371 (c)(1),
(2) Date: Dec. 4, 2020

(87) PCT Pub. No.: WO2019/234876
PCT Pub. Date: Dec. 12, 2019

(65) Prior Publication Data

US 2021/0222615 A1 Jul. 22, 2021

(51) Int. Cl.
*F02B 75/32* (2006.01)

(52) U.S. Cl.
CPC ..... *F02B 75/32* (2013.01)

(58) Field of Classification Search
CPC combination set(s) only.
See application file for complete search history.

(56) References Cited

U.S. PATENT DOCUMENTS 5,353,500 A * 10/1994 Hoag ..... B22F 5/003 29/888.09
2002/0144665 A1* 10/2002 Ushijima ..... F02B 75/045 123/48 B
2003/0131683 A1* 7/2003 Glannone ..... F16C 9/04 74/579 R
2006/0081211 A1* 4/2006 Genter ..... F02F 7/00 123/197.3
2009/0314246 A1* 12/2009 Martino ..... F16C 9/045 123/197.3
2014/0053797 A1* 2/2014 Tanabe ..... F01M 11/02 123/196 CP
2016/0201717 A1* 7/2016 Tanabe ..... F16C 7/023 123/197.3

FOREIGN PATENT DOCUMENTS

JP 2005-147376 A 6/2005
JP 2005147376 A * 6/2005

* cited by examiner

*Primary Examiner* — George C Jin
*Assistant Examiner* — Teuta B Holbrook
(74) *Attorney, Agent, or Firm* — Foley & Lardner LLP

(57) ABSTRACT

A lower link (7) is formed of two components by being divided at a dividing surface (14) including the central axis of a crank pin bearing portion (11), the two components including a lower link upper (15) with an upper pin bearing portion (12) and a lower link lower (16) with a control pin bearing portion (13). The dividing surface (14) includes a first dividing surface (14*a*) located more on the upper link side than the crank pin bearing portion (11) and a second dividing surface (14*b*) located more on the control link side than the crank pin bearing portion (11). In the lower link (7), the first dividing surface (14*a*) has a surface roughness larger than a surface roughness of the second dividing surface (14*b*).

5 Claims, 4 Drawing Sheets

MULTI-LINK PISTON CRANK MECHANISM FOR INTERNAL COMBUSTION ENGINE

TECHNICAL FIELD

The present invention relates to a multi-link piston crank mechanism for an internal combustion engine.

BACKGROUND TECHNOLOGY

A conventional multi-link piston crank mechanism for an internal combustion engine has been widely known which includes an upper link of which one end is connected to a piston via a piston pin, a lower link connected to the other end of the upper link via an upper pin and connected to a crank pin of a crankshaft, and a control link of which one end is swingably supported on the engine body side and the other end is connected to the lower link via a control pin.

In such a multi-link piston crank mechanism for an internal combustion engine, the lower link is divided into a pair of lower link members at a mating surface (dividing surface) formed along the diameter direction of a cylindrical crank pin bearing portion to which a crank pin is fitted. A pair of the lower link members is fastened to each other with a plurality of bolts, and the lower link is formed.

In such a lower link, during the operation of the engine, a force acts so as to shift (separate) a pair of the lower link members from each other along the mating surface of the lower link by a load applied to the lower link.

Consequently, there is possibility that, in the lower link, the shifting occurs along the mating surface of the lower link. In addition, there is possibility that, due to the shifting of a pair of the lower link members along the mating surface of the lower link, shearing stress is generated, and the bolts for fastening a pair of the lower link members to each other are broken.

For example, in a patent document 1, there is disclosed a technique for suppressing, by increasing a friction coefficient by performing machining to the mating surface of the lower link, the shifting of a pair of the lower link members along the mating surface of the lower link even if a load is applied to the lower link.

In the lower link of the patent document 1, machining is uniformly performed to the whole mating surface of the lower link, and a friction coefficient is not made different depending on the place.

However, the correlation between the shifting of a pair of the lower link members along the mating surface of the lower link when a load is applied to the lower link and the friction coefficient of the mating surface of the lower link is not sufficiently analyzed.

The lower link is made of an extremely hard material, and an expensive tool is therefore needed for performing machining to the mating surface of the lower link.

Therefore, the manufacturing cost of the lower link can be reduced as the range of the machining performed to the mating surface of the lower link becomes lower.

That is, in the lower link of the patent document 1, the range of the machining performed to the mating surface of the lower link is not sufficiently considered, and there is therefore room for further improving the reduction of the manufacturing cost of the lower link.

PRIOR ART REFERENCE

Patent Document

Patent Document 1: Japanese Patent Application Publication 2005-147376

SUMMARY OF THE INVENTION

A multi-link piston crank mechanism for an internal combustion engine of the present invention includes: a first link connected to a piston; a second link connected to the other end of the first link via a first connection pin, and connected to a crank pin; and a third link including one end connected to the second link via a second connection pin, and the other end supported on the engine body side.

The second link is formed of a second link upper and a second link lower by being divided at a mating surface formed by a plane surface including the central axis of a crank pin bearing portion. In the mating surface of the second link, the surface roughness of a first mating surface located more on the first link side than the crank pin bearing portion is larger than that of a second mating surface located more on the third link side than the crank pin bearing portion.

In the present invention, the shifting of the mating surface at the time when a combustion load F is applied to the second link hardly occurs even if the surface roughness of the second mating surface is set small (fine), and, based on this knowledge, the surface roughness of the first mating surface is set so as to be larger than the surface roughness of the second mating surface.

Consequently, as compared with the machining performed to the first mating surface, the machining performed to the second mating surface can be simplify, and thereby the manufacturing cost of the lower link can be entirely reduced.

MODE FOR IMPLEMENTING THE INVENTION

In the following, one embodiment of the present invention will be explained in detail based on the drawings.

Figure 1:
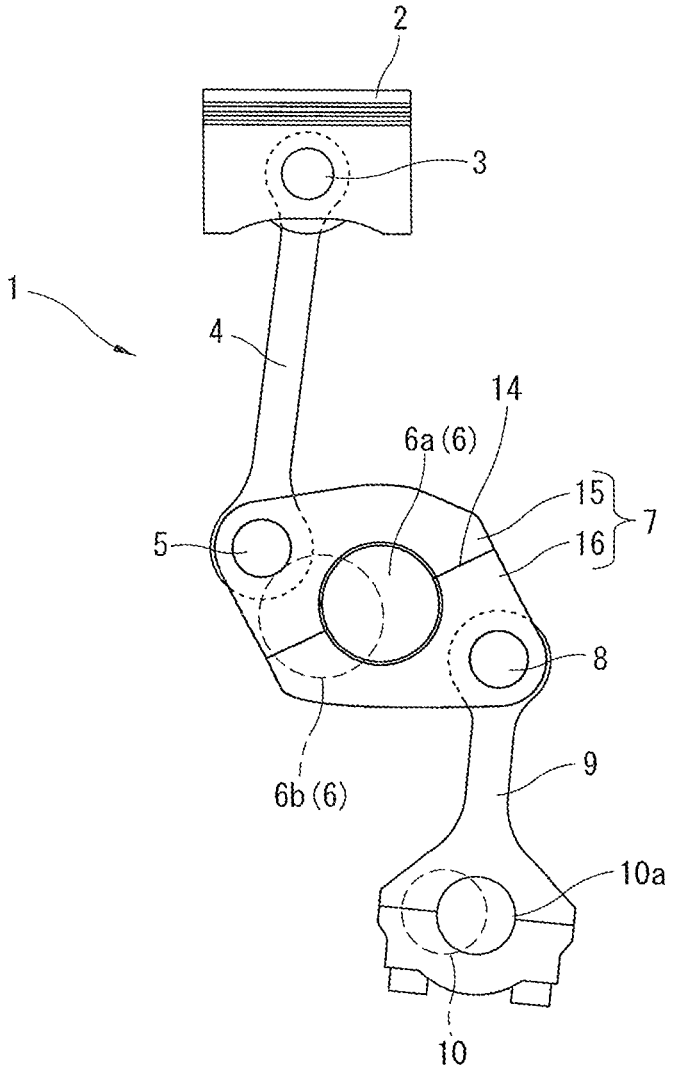
FIG. 1 is an explanatory view schematically showing the schematic configuration of a multi-link piston crank mechanism for an internal combustion engine of a first embodiment according to the present invention.

FIG. 1 is an explanatory view schematically showing the schematic configuration of a multi-link piston crank mechanism 1 for an internal combustion engine of a first embodiment to which the present invention is applied.

For example, the internal combustion engine including multi-link piston crank mechanism 1 is mounted on a vehicle such as an automobile.

Multi-link piston crank mechanism 1 is substantially composed of a piston 2, an upper link 4 as a first link, a lower link 7 as a second link, and a control link 9 as a third link.

Piston 2 is rotatably connected to one end of upper link 4 via a piston pin 3.

The other end of upper link 4 is rotatably connected to one end side of lower link 7 via an upper pin 5 as a first connection pin.

Lower link 7 is rotatably connected to a crank pin 6*a* of a crankshaft 6.

One end of control link 9 is rotatably connected to the other end side of lower link 7 via a control pin 8 as a second connection pin.

The other end of control link 9 is rotatably connected to an eccentric shaft part 10*a* of a control shaft 10 supported on the engine body side.

Control shaft 10 is one disposed parallel to crankshaft 6, and, for example, it is rotatably supposed on a cylinder block (not shown in the drawings).

That is, the other end of control link 9 which is rotatably connected to eccentric shaft part 10*a* of control shaft 10 is swingably supported on the engine body side. The central axis of eccentric shaft part 10*a* is eccentric to the rotation center of control shaft 10 by a predetermined amount.

Multi-link piston crank mechanism 1 is one in which piston 2 is linked with crank pin 6*a* of crankshaft 6 by a plurality of links.

In multi-link piston crank mechanism 1, by changing the position of eccentric shaft part 10*a* by rotating control shaft 10, the position of piston 2 at the top dead center becomes changeable, and thereby the mechanical compression ratio of the internal combustion engine can be changed.

Control shaft 10 is one for regulating the degree in freedom of lower link 7, and is rotatably controlled by an actuator composed of, for example, an electric motor.

In addition, multi-link piston crank mechanism 1 can be also formed to have a configuration in which, by fixing the position of eccentric shaft part 10*a*, the compression ratio is not changed. That is, multi-link piston crank mechanism 1 can be configured as a mechanism, in which the compression ratio is fixed, by rotatably connecting the other end of control link 9 to a supporting pin supported on the engine body side, instead of control shaft 10.

Figure 2:
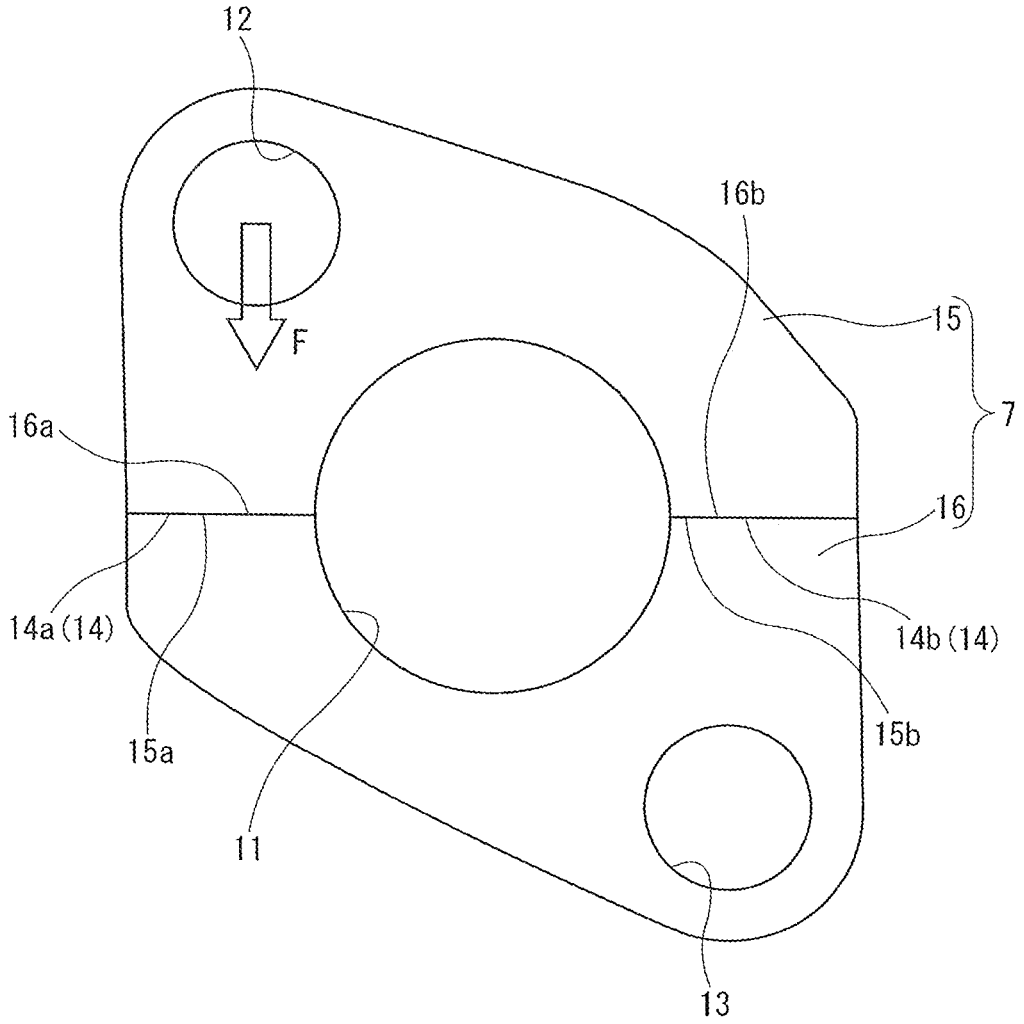
FIG. 2 is a front view of a lower link which is a main part of the multi-link piston crank mechanism for the internal combustion engine according to the present invention.

FIG. 2 is a front view of lower link 7. Lower link 7 includes, in the middle thereof, a cylindrical crank pin bearing portion 11 which is fitted to crank pin 6*a*. In addition, lower link 7 includes a pair of upper pin bearing portions 12 and a pair of control pin bearing portions 13 at positions opposite side to each other by approximately 180° with crank pin bearing portion 11 sandwiched therebetween. Upper pin bearing portion 12 is one corresponding to a first connection pin bearing portion. Control pin bearing portion 13 is one corresponding to a second connection pin bearing portion.

Lower link 7 has the shape of a parallelogram similar to a rhombus, as a whole. Lower link 7 is formed of two components by being divided at a dividing surface 14 passing through the center of crank pin bearing portion 11, the two components including a lower link upper 15 as a second link upper which has upper pin bearing portion 12 and a lower link lower 16 as a second link lower which has control pin bearing portion 13.

Each of lower link upper 15 and lower link lower 16 is one formed by forging or casting of carbon steel.

Dividing surface 14 is formed by a single plane surface including the central axis of crank pin bearing portion 11, and is a mating surface of lower link upper 15 and lower link lower 16. Dividing surface 14 includes a first dividing surface 14*a* as a first mating surface which is located more on the upper link 4 side than crank pin bearing portion 11, and a second dividing surface 14*b* as a second mating surface which is located more on the control link 9 side than crank pin bearing portion 11.

First dividing surface 14*a* is formed of an upper-side first end surface 15*a* on the lower link upper 15 side, and a lower-side first end surface 16*a* on the lower link lower 16 side. Second dividing surface 14*b* is formed of an upper-side second end surface 15*b* on the lower link upper 15 side, and a lower-side second end surface 16*b* on the lower link lower 16 side. That is, lower link upper 15 includes upper-side first end surface 15*a* forming first dividing surface 14*a* and upper-side second end surface 15*b* forming second dividing surface 14*b*. In addition, lower link lower 16 includes lower-side first end surface 16*a* forming first dividing surface 14*a* and lower-side second end surface 16*b* forming second dividing surface 14*b*.

As shown in FIG. 2, dividing surface 14 of lower link 7 is orthogonal to the input direction of a combustion load F. In addition, first dividing surface 14*a* is a surface to which, as a compressive load, combustion load F is applied.

Dividing surface 14 is inclined with respect to the lower link width direction along a straight line connecting the center of upper pin bearing portion 12 and the center of control pin bearing portion 13, when viewed in the crankshaft axial direction. In other words, dividing surface 14 is inclined with respect to a plane surface including the central axis of upper pin bearing portion 12 and the central axis of control pin bearing portion 13.

In the present embodiment, the upper pin bearing portion 12 side in the lower link width direction is defined as one end side of lower link 7, and the control pin bearing portion 13 side in the lower link width direction is defined as the other end side of lower link 7.

These lower link upper 15 and lower link lower 16 are fastened to each other with a pair of bolts (not shown in the drawings) which is inserted so as to be opposite to each other, after crank pin bearing portion 11 is fitted to crank pin 6*a*. That is, lower link upper 15 and lower link lower 16 are fastened to each other with two bolts arranged on the respective both sides of crank pin bearing portion 11. In addition, lower link upper 15 and lower link lower 16 may be fastened to each other with two or more bolts.

Inventors of the present application analyzed the behavior of dividing surface 14 of lower link 7 when combustion load F was applied. As a result, in first dividing surface 14*a* on the upper link 4 side, it was found that the shifting occurred when the friction coefficient was set to be small. In addition, in second dividing surface 14*b* on the control link 9 side, it was found that the shifting hardly occurred even if the friction coefficient was set to be small. That is, in second dividing surface 14*b* on the control link 9 side, it was found that, even if machining was omitted so as to make the surface roughness small (fine), the shifting at the time when combustion load F was applied to lower link 7 hardly occurred.

Therefore, in lower link 7, the surface roughness of first dividing surface 14*a* is set so as to be larger (rougher) than that of second dividing surface 14*b*.

Figure 3:
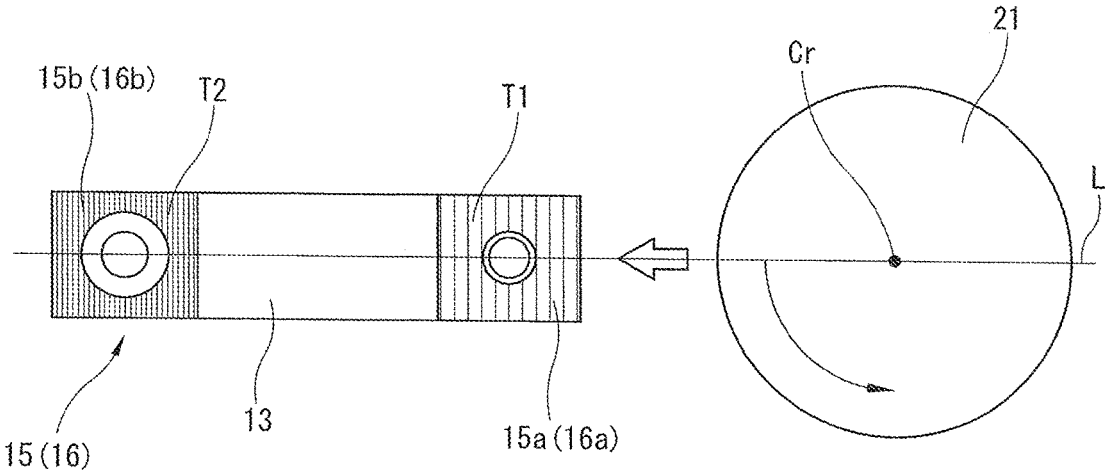
FIG. 3 is an explanatory view schematically showing a process for performing machining to a dividing surface of the lower link.

Specifically, as shown in FIG. 3, machining (for example, grinding using a disk-like tool 21) is carried out to first dividing surface 14*a*.

That is, the machining is carried out to upper-side first end surface 15*a* of lower link upper 15 and lower-side first end surface 16*a* of lower link lower 16.

Figure 4:
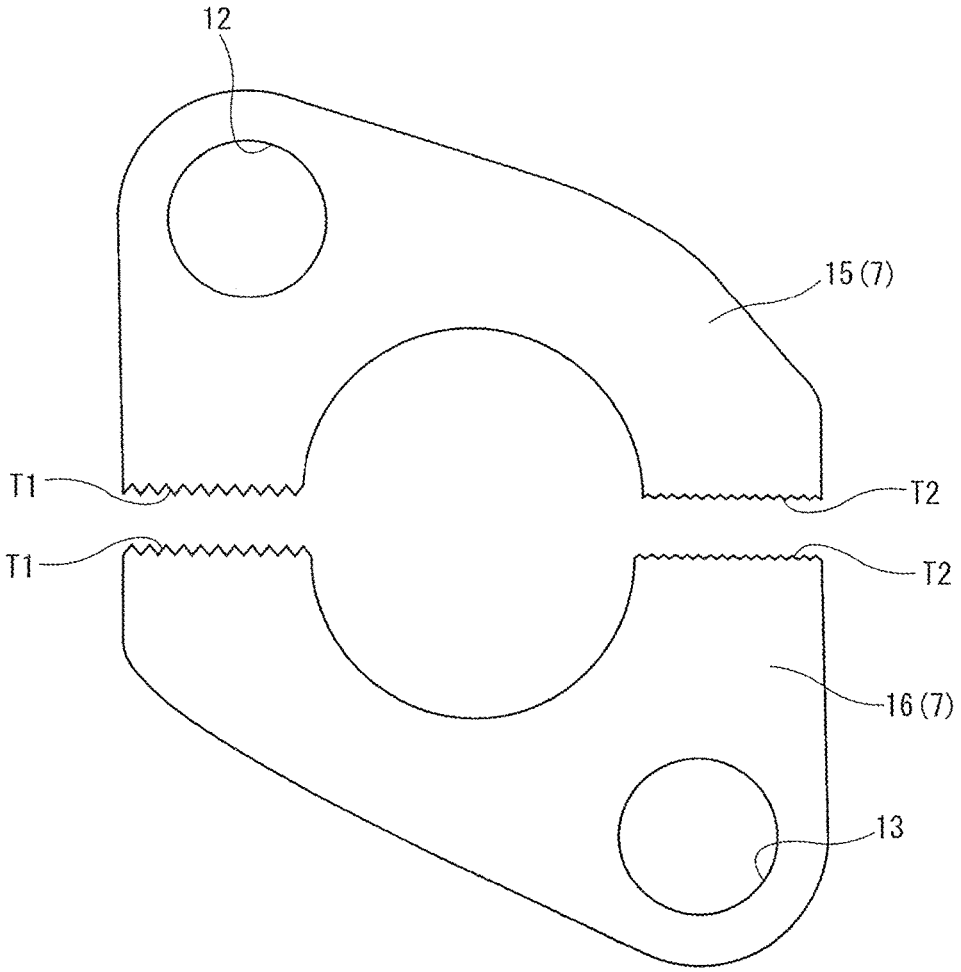
FIG. 4 is an explanatory view schematically showing the lower link which is a main part of the multi-link piston crank mechanism for the internal combustion engine according to the present invention.

As shown in FIG. 3 and FIG. 4, a tool mark T1 extending along the axial direction of crank pin bearing portion 11 is formed to upper-side first end surface 15*a* and lower-side first end surface 16*a*.

Tool mark T1 is one in which a peak and a trough are alternately and repeatedly continued along the radial direction of crank pin bearing portion 11. That is, in first dividing surface 14*a*, a peak and a trough are alternately and repeatedly continued along the radial direction of crank pin bearing portion 11, and thereby the surface roughness of the mating surfaces of both of lower link upper 15 and lower link lower 16 becomes large. In other words, first dividing surface 14*a* is formed to have a predetermined surface roughness by forming the mating surfaces of both of lower link upper 15 and lower link lower 16 such that a peak and a trough are alternately and repeatedly continued along the radial direction of crank pin bearing portion 11.

In first dividing surface 14*a*, tool mark T1 of upper-side first end surface 15*a* meshes with tool mark T1 of lower-side first end surface 16*a*, and thereby the shifting which occurs at the time when combustion load F is applied to lower link 7 can be efficiently suppressed.

As shown in FIG. 3, tool mark T1 is formed by rotating disk-like tool 21 for grinding.

Since, as compared with the length of lower link upper 15 and lower link lower 16 along the axial direction of crank pin bearing portion 11, the diameter of tool 21 is sufficiently large, tool mark T1 is formed so as to be substantially parallel to the axial direction of crank pin bearing portion 11.

Upper-side first end surface 15*a* and lower-side first end surface 16*a* are ground by horizontally moving tool 21 such that a center Cr of tool 21 passes through the center position along the axial direction of crank pin bearing portion 11 in plane view (as shown in FIG. 3). A straight line L in FIG. 3 is a straight line passing through the center position along the axial direction of crank pin bearing portion 11.

Second dividing surface 14*b* is formed such that a surface roughness Ra is smaller than the surface roughness of first dividing surface 14*a*. That is, second dividing surface 14*b* has a surface roughness formed by being ground with only a common grindstone, and, in some cases, post-processing can be omitted.

That is, it is not necessary to perform the machining, which is performed to first dividing surface 14*a*, to upper-side second end surface 15*b* of lower link upper 15 and lower-side second end surface 16*b* of lower link lower 16. Furthermore, it is sufficient to perform grinding to upper-side second end surface 15*b* and lower-side second end surface 16*b* with a common grindstone, even in a case where machining is carried out, and, in some cases, the machining can be omitted.

Grinding by using a common grindstone is carried out to second dividing surface 14*b* in the first embodiment.

That is, grinding by using a common grindstone is carried out to upper-side second end surface 15*b* of lower link upper 15 and lower-side second end surface 16*b* of lower link lower 16.

As shown in FIG. 3 and FIG. 4, a tool mark T2 extending along the axial direction of crank pin bearing portion 11 is formed to upper-side second end surface 15*b* and lower-side second end surface 16*b* of the first embodiment. Such a tool mark T2 is formed by rotating a grindstone (not shown in the drawings) so as to grind upper-side second end surface 15*b* and lower-side second end surface 16*b*.

Tool mark T2 is one in which a peak and a trough are alternately and repeatedly continued along the radial direction of crank pin bearing portion 11. That is, in second dividing surface 14*b*, the mating surfaces of lower link upper 15 and lower link lower 16 are formed such that a peak and a trough are alternately and repeatedly continued along the radial direction of crank pin bearing portion 11. However, tool mark T2 is smaller than tool mark T1. The surface roughness of second dividing surface 14*b* is therefore smaller than that of first dividing surface 14*a*. In other words, in the mating surfaces of both of lower link upper 15 and lower link lower 16 in second dividing surface 14*b*, a peak and a trough are alternately and repeatedly continued along the radial direction of crank pin bearing portion 11, and second dividing surface 14*b* has a predetermined surface roughness which is smaller than the surface roughness of first dividing surface 14*a*.

In lower link 7 of the first embodiment mentioned above, in lower link 7, machining by tool 21 is carried out to first dividing surface 14*a*, and machining by tool 21 is not carried out to second dividing surface 14*b*. Lower link 7 is formed such that the surface roughness of first dividing surface 14*a* is larger than that of second dividing surface 14*b*.

Consequently, the machining by tool 21 is carried out to only a range required for suppressing the shifting between lower link upper 15 and lower link lower 16 in dividing surface 14 of lower link 7 at the time when combustion load F is applied to lower link 7.

Therefore, a range of the machining by tool 21 can be reduced, and the manufacturing cost of lower link 7 can be reduced. In other words, as compared with first dividing surface 14*a*, in second dividing surface 14*b*, machining can be simplified, and thereby the manufacturing cost of lower link 7 can be totally reduced. In addition, frequency in use of tool 21 becomes low, and the life of tool 21 can be extended.

In addition, in first dividing surface 14*a*, the machining by tool 21 may be carried out to one of upper-side first end surface 15*a* of lower link upper 15 and lower-side first end surface 16*a* of lower link lower 16 if the shifting which occurs at the time when combustion load F is applied to lower link 7 can be suppressed.

In the following, another embodiment of the present invention will be explained. In addition, the same symbols of the embodiment mentioned above are applied to the same components, and redundant explanation is omitted.

Figure 5:
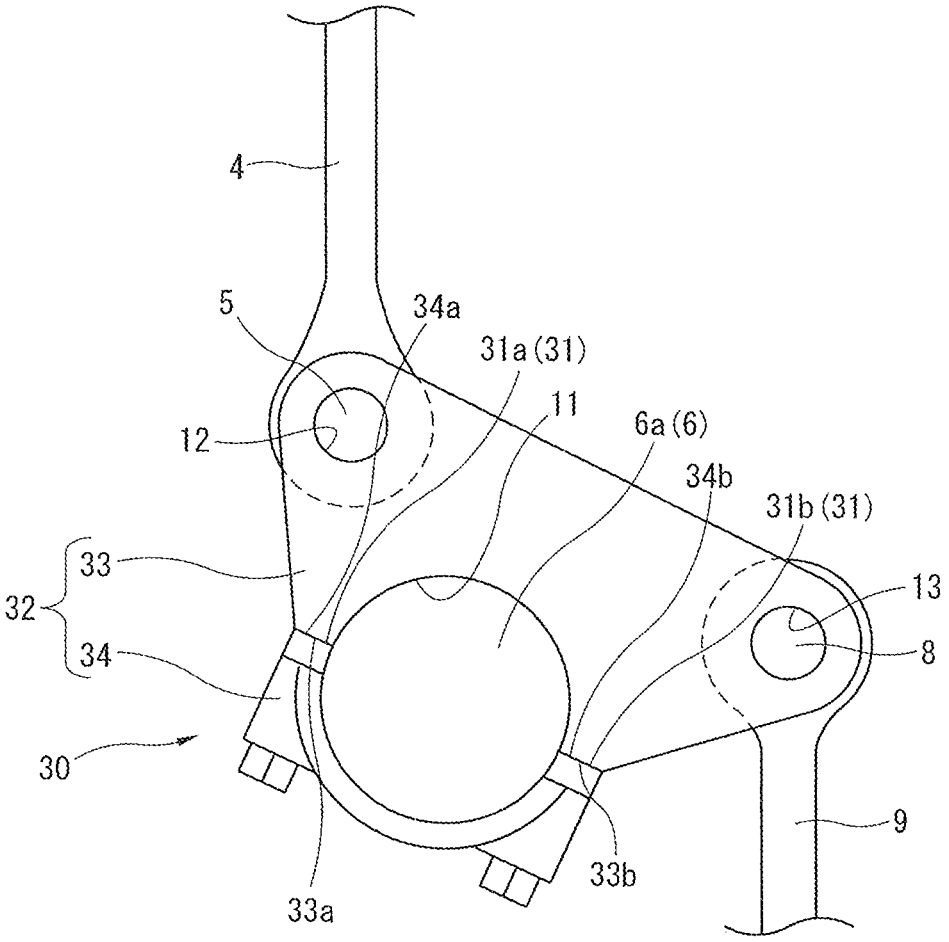
FIG. 5 is an explanatory view schematically showing the schematic configuration of the multi-link piston crank mechanism for the internal combustion engine of a second embodiment according to the present invention.

FIG. 5 is an explanatory view schematically showing the schematic configuration of a multi-link piston crank mechanism 30 for an internal combustion engine of a second embodiment to which the present invention is applied.

Although multi-link piston crank mechanism 30 has the substantially same configuration as multi-link piston crank mechanism 1 of the first embodiment mentioned above, a lower link 32 is divided into two components such that a lower link upper 33 includes an upper pin bearing portion 12 and a control pin bearing portion 13.

That is, lower link 32 is formed of two components of lower link upper 33 as a second link upper, which includes upper pin bearing portion 12 and control pin bearing portion 13, and a lower link lower 34 as a second link lower formed of a part other than lower link upper 33, by being divided at a dividing surface 31 formed by a single plane surface including the central axis of a crank pin bearing portion 11.

Dividing surface 31 of lower link 32 is orthogonal to the input direction of a combustion load F.

Dividing surface 31 includes a first dividing surface 31*a* as a first mating surface which is located more on the upper link 4 side than crank pin bearing portion 11 and a second dividing surface 31*b* as a second mating surface which is located more on the control link 9 side than crank pin bearing portion 11. First dividing surface 31*a* is a surface to which, as a compressive load, combustion load F is applied.

When viewed in the crankshaft axial direction, dividing surface 31 of the second embodiment is substantially parallel to the straight line connecting the center of upper pin bearing portion 12 and the center of control pin bearing portion 13. In other words, dividing surface 31 is substantially parallel to the plane surface including the central axis of upper pin bearing portion 12 and the central axis of control pin bearing portion 13.

Lower link upper 33 includes an upper-side first end surface 33*a* forming first dividing surface 31*a*, and an upper-side second end surface 33*b* forming second dividing surface 31*b*. In addition, lower link lower 34 includes a lower-side first end surface 34*a* forming first dividing surface 31*a*, and a lower-side second end surface 34*b* forming second dividing surface 31*b*.

Then, in lower link 32, the surface roughness of first dividing surface 31*a* on the upper link 4 side is larger (rougher) than that of second dividing surface 31*b* on the control link 9 side.

In lower link 32, machining by the above-mentioned tool 21 is carried out to first dividing surface 31*a*, and the machining by tool 21 is not carried out to second dividing surface 31*b*.

A tool mark extending along the axial direction of crank pin bearing portion 11 is formed to upper-side first end surface 33*a* and lower-side first end surface 34*a*. This tool mark is one in which a peak and a trough are alternately and repeatedly continued along the radial direction of crank pin bearing portion 11.

In first dividing surface 31*a*, the tool mark of upper-side first end surface 33*a* meshes with the tool mark of lower-side first end surface 34*a*, and thereby the shifting which occurs at the time when combustion load F is applied to lower link 32 can be effectively suppressed.

Even in a case where machining is carried out to upper-side second end surface 33*b* and lower-side second end surface 34*b*, it is sufficient to perform grinding with a common grindstone, and, in some cases, the machining can be omitted.

In a case where machining is carried out to upper-side second end surface 33*b* and lower-side second end surface 34*b*, the machining is carried out such that a tool mark extending along the axial direction of crank pin bearing portion 11 is formed to upper-side second end surface 33*b* and lower-side second end surface 34*b*. This tool mark is one in which a peak and a trough are alternately and repeatedly continued along the radial direction of crank pin bearing portion 11.

In multi-link piston crank mechanism 30 of the second embodiment, almost the same working effect as the above-mentioned multi-link piston crank mechanism 1 can be also obtained.

In addition, in first dividing surface 31*a*, if the shifting which occurs at the time when combustion load F is applied to lower link 32 can be suppressed, machining by tool 21 may be carried out to only one of upper-side first end surface 33*a* of lower link upper 33 and lower-side first end surface 34*a* of lower link lower 34.

The invention claimed is:

1. A multi-link piston crank mechanism for an internal combustion engine, comprising:

a first link including one end connected to a piston via a piston pin;

a second link connected to an other end of the first link via a first connection pin, and connected to a crank pin of a crankshaft; and a third link including one end connected to the second link via a second connection pin, and an other end supported on an engine body side, wherein the second link includes a crank pin bearing portion fitted to the crank pin, and is formed of a second link upper and a second link lower by being divided at a mating surface formed by a plane surface including a central axis of the crank pin bearing portion, wherein the mating surface includes a first mating surface located more on a first link side than the crank pin bearing portion, and a second mating surface located more on a third link side than the crank pin bearing portion, and wherein a surface roughness of the first mating surface is larger than that of the second mating surface.

2. The multi-link piston crank mechanism for the internal combustion engine according to claim 1, wherein, in the first mating surface, roughness of mating surfaces of both of the second link upper and the second link lower is large.

3. The multi-link piston crank mechanism for the internal combustion engine according to claim 1, wherein a first end surface of the second link upper which forms the first mating surface and a second end surface of the second link lower which forms the first mating surface are each formed such that a peak and a trough are alternately and repeatedly continued along a radial direction of the crank pin bearing portion, so as to have a predetermined surface roughness.

4. The multi-link piston crank mechanism for the internal combustion engine according to claim 1, wherein the mating surface of the second link is orthogonal to a combustion load.

5. The multi-link piston crank mechanism for the internal combustion engine according to claim 1, wherein the first mating surface is a surface to which a combustion load is applied as a compressive load.

* * * * *